US010982673B2

(12) United States Patent
Peroni et al.

(10) Patent No.: US 10,982,673 B2
(45) Date of Patent: Apr. 20, 2021

(54) AUTOMOTIVE VACUUM PUMP

(71) Applicant: PIERBURG PUMP TECHNOLOGY GMBH, Neuss (DE)

(72) Inventors: Giorgio Peroni, Pisa (IT); Raffaele Squarcini, Leghorn (IT); Michael Rombach, Neuss (DE); Andreas Kuhnekath, Moenchengladbach (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 270 days.

(21) Appl. No.: 16/082,275

(22) PCT Filed: Mar. 7, 2016

(86) PCT No.: PCT/EP2016/054802
§ 371 (c)(1),
(2) Date: Sep. 5, 2018

(87) PCT Pub. No.: WO2017/152939
PCT Pub. Date: Sep. 14, 2017

(65) Prior Publication Data

US 2019/0093656 A1 Mar. 28, 2019

(51) Int. Cl.

| | |
|---|---|
| ***F01C 21/10*** | (2006.01) |
| ***F01C 21/08*** | (2006.01) |
| F04C 25/02 | (2006.01) |
| ***F04C 18/344*** | (2006.01) |
| ***F04C 29/12*** | (2006.01) |
| ***F04C 29/02*** | (2006.01) |
| ***F04C 29/00*** | (2006.01) |

(52) U.S. Cl.
CPC ..... *F04C 25/02* (2013.01); *F01C 21/089* (2013.01); *F01C 21/108* (2013.01);
(Continued)

(58) Field of Classification Search
CPC .. F04C 25/02; F04C 18/3441; F04C 29/0021; F04C 29/0071; F04C 29/025;
(Continued)

(56) References Cited

U.S. PATENT DOCUMENTS 5,177,966 A * 1/1993 Takai ..... F04C 14/26 60/468
5,372,489 A * 12/1994 Matsuda ..... F04C 23/001 417/250
(Continued)

FOREIGN PATENT DOCUMENTS

CN 103314216 A 9/2013
DE 198 34 033 A1 2/1999
(Continued)

OTHER PUBLICATIONS

English Translation of DE-19834033-A1 (Pachetti) obtained Jul. 27, 2020 (Year: 2020).*

*Primary Examiner* — Connor J Tremarche
(74) *Attorney, Agent, or Firm* — Norman B. Thot

(57) ABSTRACT

A vacuum pump for pumping a gas includes a pump housing which defines a pump cavity, a shiftable vane, a pump rotor body, a separate axial rotor retaining arrangement, and a radial friction bearing. The pump housing includes a closed housing wall. The pump rotor body includes a vane slit which supports the shiftable vane to define rotating pumping chambers, an axial low-pressure end which is axially supported by the closed housing wall so that a gas pressure inside the pumping chambers is present at the low-pressure end, and an axial high-pressure end. The pump housing is fluidically open at the axial high-pressure end so that atmospheric pressure is present. The axial rotor retaining arrangement includes a retaining sheet body arranged in a transversal plane which axially in part blocks the axial high-pressure end. The radial friction bearing is arranged axially between the vane slit and the axial high-pressure end.

11 Claims, 3 Drawing Sheets

(52) U.S. Cl.
CPC ..... *F04C 18/3441* (2013.01); *F04C 29/0021* (2013.01); *F04C 29/0071* (2013.01); *F04C 29/025* (2013.01); *F04C 29/124* (2013.01); *F04C 29/128* (2013.01)

(58) Field of Classification Search
CPC ..... F04C 29/124; F04C 29/128; F01C 1/089; F01C 1/108
See application file for complete search history.

(56) References Cited

U.S. PATENT DOCUMENTS 5,924,856 A * 7/1999 Murayama ..... F04C 18/3446 418/133
2008/0159896 A1* 7/2008 Kishi ..... F04C 18/3442 418/88
2010/0016116 A1* 1/2010 Kenez ..... B62D 5/008 475/339
2016/0047482 A1 2/2016 Kuhnekath

FOREIGN PATENT DOCUMENTS

DE 19834033 A1 * 2/1999 ..... F01C 21/10
DE 198 44 904 C1 2/2000
DE 10 2009 008 630 A1 10/2009
EP 0 515 929 A1 12/1992
FR 2 869 958 A1 11/2005
WO WO 2006/005380 A1 1/2006
WO WO 2010/145633 A2 12/2010
WO WO 2014/154239 A1 10/2014

* cited by examiner

AUTOMOTIVE VACUUM PUMP

CROSS REFERENCE TO PRIOR APPLICATIONS

This application is a U.S. National Phase application under 35 U.S.C. § 371 of International Application No. PCT/EP2016/054802, filed on Mar. 7, 2016. The International Application was published in English on Sep. 14, 2017 as WO 2017/152939 A1 under PCT Article 21(2).

FIELD

The present invention relates to an automotive vacuum pump for generating a vacuum, namely, an absolute pressure of below 600 millibar, for actuating pneumatic automotive devices.

BACKGROUND

The vacuum pump according to the present invention can be driven mechanically, for example, by an internal combustion engine, or can be driven electrically by an electric motor. The vacuum pump according to the present invention is a vane pump comprising a pump housing defining a pump cavity and comprising a rotatable pump rotor body with at least one vane slit supporting a shiftable vane. The shiftable vane rotating in the pump cavity separates and defines at least two rotating pumping chambers.

Typical examples of automotive vacuum pumps are described in DE 198 44 904 and in WO 2014/154239 A1.

SUMMARY

An aspect of the present invention is to provide a simple and cost-effective automotive vacuum vane pump.

In an embodiment, the present invention provides an automotive vacuum pump for pumping a gas. The automotive vacuum pump includes a pump housing configured to define a pump cavity, a shiftable vane, a pump rotor body, a separate axial rotor retaining arrangement, and a radial friction bearing. The pump housing comprises a closed housing wall. The pump rotor body comprises at least one vane slit which is configured to support the shiftable vane so as to define at least two rotating pumping chambers, an axial low-pressure end which is axially supported by the closed housing wall so that a gas pressure inside the at least two rotating pumping chambers is present at the low-pressure end of the pump rotor body, and an axial high-pressure end. The pump housing is configured to be fluidically open at the axial high-pressure end so that atmospheric pressure is present at the axial high-pressure end. The separate axial rotor retaining arrangement comprises a separate retaining sheet body which is arranged in a transversal plane and which is configured to axially block at least partially the axial high-pressure end of the pump rotor body. The radial friction bearing is arranged axially between the at least one vane slit and the axial high-pressure end of the pump rotor body.

BRIEF DESCRIPTION OF THE DRAWINGS

The present invention is described in greater detail below on the basis of embodiments and of the drawings in which.

DETAILED DESCRIPTION

Figure 1:
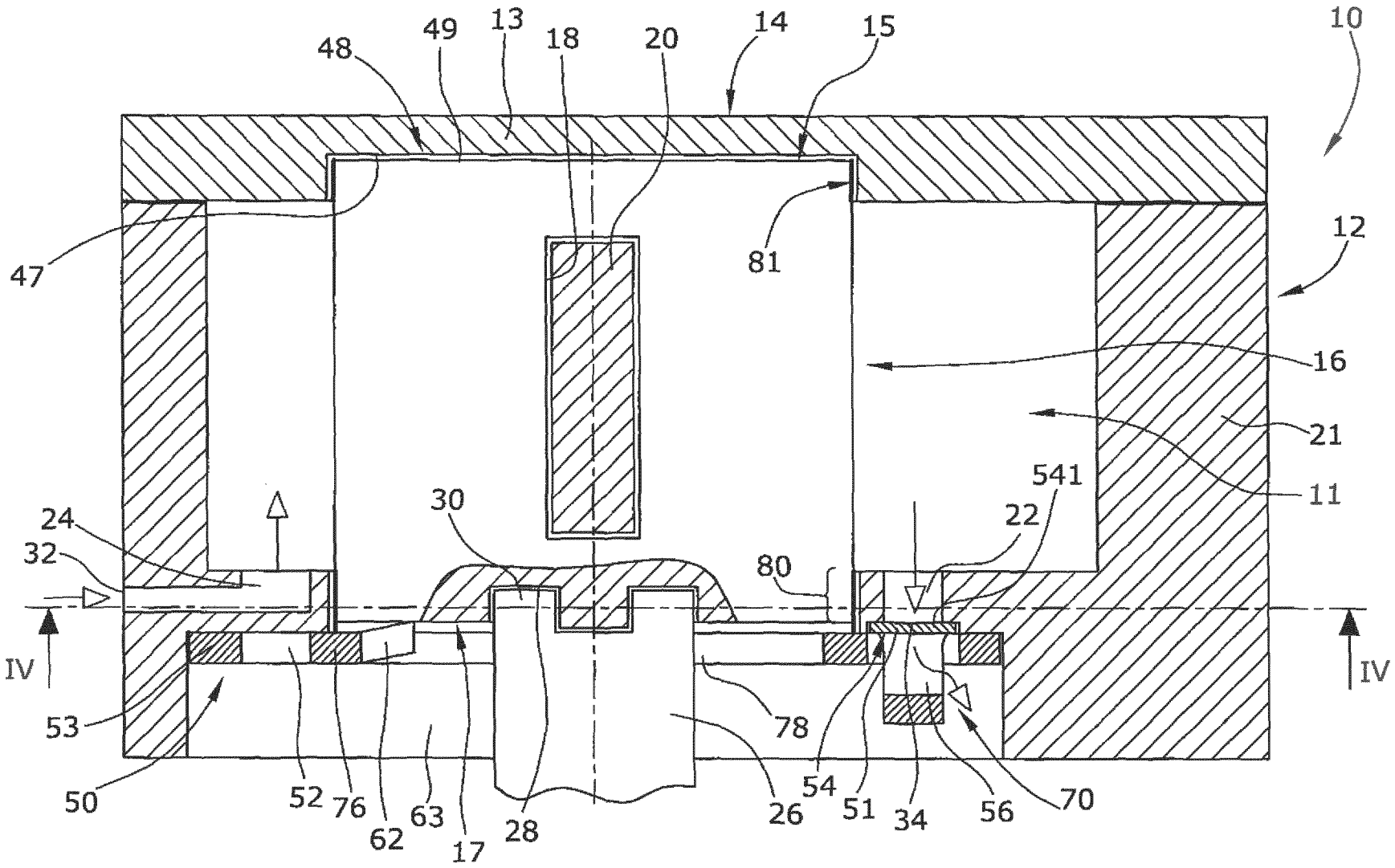
FIG. 1 shows a longitudinal section of an automotive vacuum vane pump according to the present invention.

The automotive vacuum vane pump according to the present invention is provided with a pump housing which defines a pump cavity within the pump housing. A pump rotor body is rotatably arranged within the pump cavity and is provided with at least one vane slit supporting at least one shiftable vane defining at least two rotating pumping chambers. The pumping chambers are completely defined by the outside circumferential surface of the pump rotor body, the lateral inside housing wall surface, the axial inside housing wall surfaces, and by the vane which separates the pump cavity into the at least two rotating pumping chambers.

The pump rotor body has two axial ends, namely, an axial low-pressure end and an axial high-pressure end. The low-pressure end of the pump rotor body is axially supported by a closed housing wall. When the vacuum pump is operating, the pressure at the low-pressure end of the pump rotor body is equal to or close to the vacuum pressure inside the pump cavity and the rotating pumping chambers. The pump housing is open to atmospheric pressure at the other axial end of the pump rotor body, namely, at the high-pressure end. When the vacuum pump is operating, the pump rotor body is therefore axially pushed in the direction of the closed housing wall by the pressure difference between the pressures at the high-pressure end and the low-pressure end.

The vacuum pump is provided with a radial friction bearing which is axially arranged between the vane slit and the high-pressure end of the pump rotor body. The radial friction bearing has two functions, namely, to provide a radial bearing for rotatably supporting the pump rotor body at the pump housing, and to provide a sealing structure pneumatically separating the pump cavity from atmospheric pressure.

A separate axial rotor retaining arrangement is provided at the high-pressure end of the pump rotor body. The rotor retaining arrangement is defined by a retaining sheet body which can, for example, be a metal sheet body. The retaining sheet body is arranged in a transversal plane, which is a plane perpendicular to the rotational axis of the pump rotor body. The retaining sheet body at least partially axially blocks the high-pressure end of the pump rotor body so that the pump rotor body is blocked from significantly moving axially into the direction of the high-pressure end. The retaining sheet body does not serve as an axial bearing because, under normal operating conditions, the pressure difference between the two axial rotor body ends is normally sufficient to move and push the rotor body into the other direction, namely, into the direction of the low-pressure end of the rotor body. The retaining sheet body has the object of keeping the rotor body in an axial operating position if the pressure difference is not sufficient, and in particular if the vacuum pump is not operative or is starting.

In an embodiment of the present invention, the retaining sheet body can, for example, define a retaining ring for blocking the outer ring portion of the high-pressure end of the pump rotor body. Only the outer ring portion of the pump rotor body is axially blocked by the retaining sheet body. The retaining sheet body can, for example, define a center opening so that a coupling structure of the rotor body is axially accessible for a corresponding coupling structure of a drive.

In an embodiment of the present invention, the automotive vacuum pump can, for example, be of the lubricated type. The friction surfaces of the pump rotor are lubricated. A lubrication conduit arrangement can, for example, be provided to lubricate the radial friction bearing with a lubrication liquid. The lubrication conduit arrangement comprises one or more lubrication conduits in the pump housing and/or the rotor body for providing a pressurized lubricant to frictional portions of the pump. The lubrication also significantly reduces friction and wear, and also has a sealing effect.

In an embodiment of the present invention, the retaining sheet body can, for example, define a spring stopper of a fluidic pump outlet valve. The spring stopper is an integral part of the retaining sheet body. The vacuum pump is provided with at least one outlet valve through which the pumped gas/air and, if present, the liquid lubricant, exit the vacuum pump. The pump outlet is provided with the fluidic one-way pump outlet valve which can, for example, also comprise a spring sheet valve body which is arranged between the retaining sheet body and the pump housing. The pump outlet valve can, for example, be a spring sheet valve. The maximum opening position of the valve body, which is a spring sheet, is limited by the spring stopper defined by the retaining sheet body. The retaining sheet body has two functions, namely, keeping the rotor body at its correct axial position and to define a spring stopper.

In an embodiment of the present invention, two separate pump outlet valves can, for example, be provided at the high-pressure end of the pump housing. Providing two different pump outlets with a separate respective outlet valve allows the rotating pumping chamber to completely discharge, especially in the final compression phase if both outlet valves are provided in the section defining the final compression phase. One of the two outlet valves is alternatively provided at the section defining the suction phase to allow the pump to also be driven in reverse. The discharge of the liquid lubricant in the final compression phase of the rotating pumping chamber is improved significantly by providing two separate outlets with separate outlet valves. The retaining sheet body defines the respective spring stoppers of both outlet valves. Both spring stoppers are an integral part of the retaining sheet body.

In an embodiment of the present invention, the retaining sheet body can, for example, integrally define an elastic rotor biasing element for axially pushing the pump rotor body away from the sheet body. The pump housing and the pump rotor body can be made of different materials with different thermal expansion coefficients. The pump housing can, for example, be made out of metal and the pump rotor body can, for example, be made out of plastic. The elastic rotor biasing element provides that the low-pressure end surface of the pump rotor is axially always in touch with and supported by the corresponding closed housing wall. The axial friction bearing can, for example, be defined by the front end surface at the low-pressure end of the pump rotor and by a corresponding housing cover defining the closed housing wall.

The vacuum pump is provided with only one axial friction bearing because, when operated, the pump rotor is axially pushed by the axial pressure difference against the single axial friction bearing.

In an embodiment of the present invention, the lateral outside of the pump rotor body can, for example, be completely stepless and have a cylindrical shape over its entire axial extend. The pump rotor body is completely cylindrical. The pump rotor body is therefore not provided with any circumferential step which could serve as a retaining device. A cylindrical pump rotor body is simple and cost-effectively producible.

In an embodiment of the present invention, the pump rotor body can, for example, be provided with one single continuous vane slit supporting one single vane separating the pump cavity into two rotating pumping chambers.

An embodiment of the present invention is described below under reference to the drawings.

The drawings show an automotive vacuum pump 10 for generating a vacuum with an absolute pressure of below 600 mbar. The vacuum pump 10 generates the vacuum for automotive devices which are pneumatically actuated, for example, brake servo units, flaps, switches etc.

The vacuum pump 10 comprises a metal pump housing 12 which is made of two separate housing parts, namely, a housing main body 21 and a housing cover 14 at one axial end of the pump housing 12. The pump housing 12 surrounds and defines a pump cavity 11. The pump housing 12 supports a rotatable plastic pump rotor body 16 of which the lateral outside surface is completely cylindrical and stepless in shape. The pump rotor body 16 is provided with a single continuous radial vane slit 18 supporting a single shiftable vane 20 which separates the pump cavity 11 into two rotating pumping chambers.

The pump housing 12 and the pump rotor body 16 together define two separate radial friction bearings 80, 81, namely, one radial friction bearing 81 at the low-pressure end 15 of the pump rotor body 16 and another radial friction bearing 80 at the high pressure front end 17 of the pump rotor body 16. At the low-pressure end 15, the radial friction bearing 81 is defined by a cylindrical bearing ring surface of the housing cover 14 and the corresponding cylindrical outside surface of an end portion of the pump rotor body 16. The housing cover 14 is also provided with a housing cover wall 13 lying in a transversal plane with respect to the rotation axis of the pump rotor body 16. The inside surface 47 of the housing cover wall 13 and the low-pressure sided front end rotor surface 49 of the pump rotor body 16 together define an axial friction bearing 48.

The pump housing 12 is pneumatically closed at the low-pressure end 15 of the pump rotor body 16 so that, when the vacuum pump 10 is operating, the low pressure generated within the pump cavity 11 is also present at the axial friction bearing 48. The pump housing 12 is pneumatically open at the other axial end, namely at the high pressure end 17 of the pump rotor body 16. The complete axial end surface of the pump rotor body 16 at its high pressure front end 17 is therefore always under atmospheric pressure which is, when the vacuum pump 10 is operating, higher than the vacuum pressure at the other axial end, i.e., the low pressure end 15, of the pump rotor body 16.

The high-pressure sided radial friction bearing 80 is defined by a cylindrical outside ring surface portion of the pump rotor body 16 and a corresponding cylindrical inside ring surface portion of the housing main body 21.

The present vacuum pump 10 is a mechanical pump which is mechanically driven by a drive 26 which is driven by an internal combustion engine. The high-pressure front end 17 of the pump rotor body 16 is provided with a coupling structure 28 which is complementary to a corresponding coupling structure 30 of the drive 26.

Figure 4:
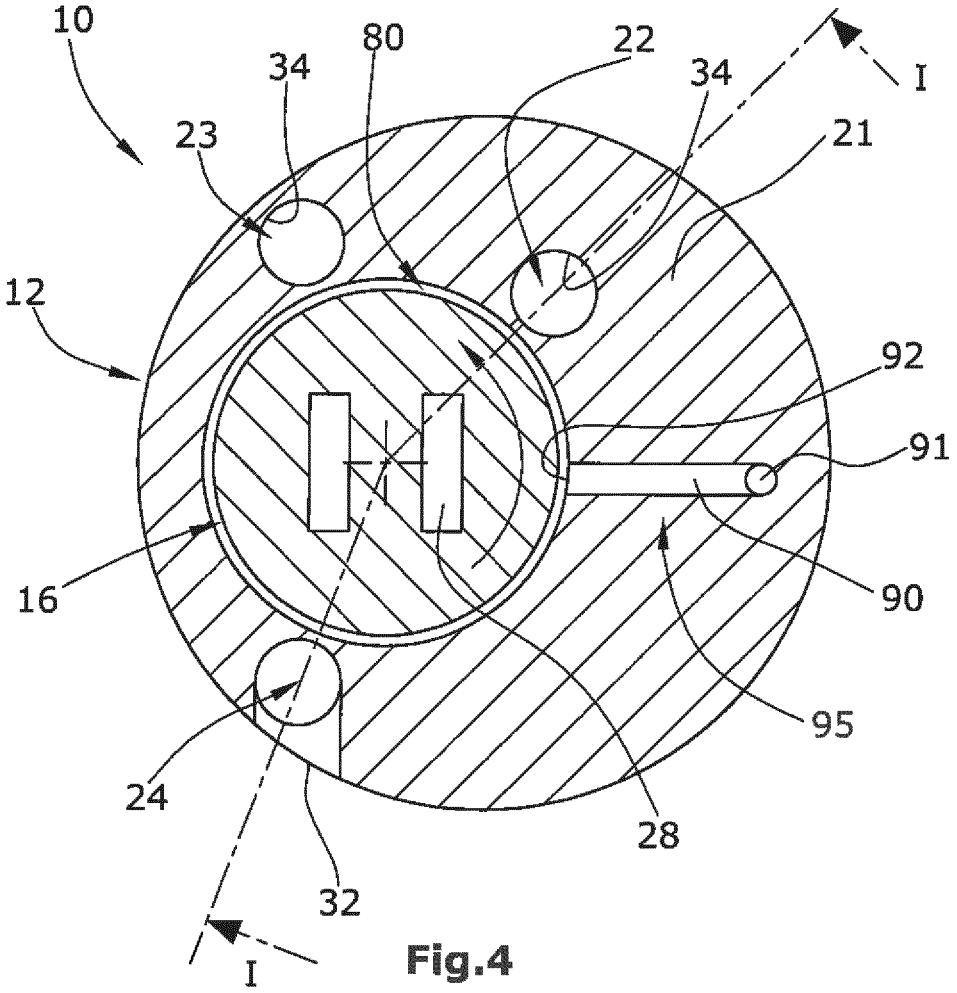
FIG. 4 shows a cross section IV-IV of the pump of FIG. 1.

The housing main body 21 is also provided with an axial gas inlet channel 24 and two axial outlet channels 22, 23, as can also be seen in FIG. 4. The gas inlet channel 24 is located at the beginning of the pump cavity 11, as seen in the rotational direction, where the local volume of the pump cavity increases starting from zero. The two outlet channels 22, 23, which are outlet channels for air and also for a liquid lubricant, are located at the end of the pump cavity 11, as seen in the rotational direction, where the local volume of the pump cavity 11 decreases down to zero. The housing main body 21 comprises a lateral pump inlet opening 32 defining the inlet of the gas inlet channel 24 and two axial valve openings 34 defining the outlet openings of the two axial outlet channels 22, 23.

The radial friction bearing 80 at the high pressure front end 17 is axially completely open so that the pump rotor body 16 is not axially supported directly by the housing main body 21 and can axially be inserted into the housing main body 21 through the radial friction bearing 80.

As can be seen in FIG. 4, the housing main body 21 is provided with a lubrication conduit arrangement 95 for lubricating the radial friction bearing 80 and all other friction surfaces with the lubrication liquid. The lubrication conduit arrangement 95 comprises a radial lubrication conduit 90 leading into a lubricant outlet opening 92 and comprises an axial lubrication conduit 91. The lubrication conduit arrangement 95 can comprise other lubrication conduits for directly providing the pressurized lubricant to other friction surfaces.

The high-pressure end of the pump housing 12 is mechanically closed by a rotor retaining arrangement 50 which is defined by a separate metal retaining sheet body 53 orientated and arranged in a transversal plane with respect to the rotational axis of the pump rotor body 16. The retaining sheet body 53 is axially and radially fixed to the housing main body 21 and is arranged within a corresponding recess 63 of the housing main body 21 so that no parts of the retaining sheet body 53 protrudes from the silhouette of the pump housing 12.

Figure 2:
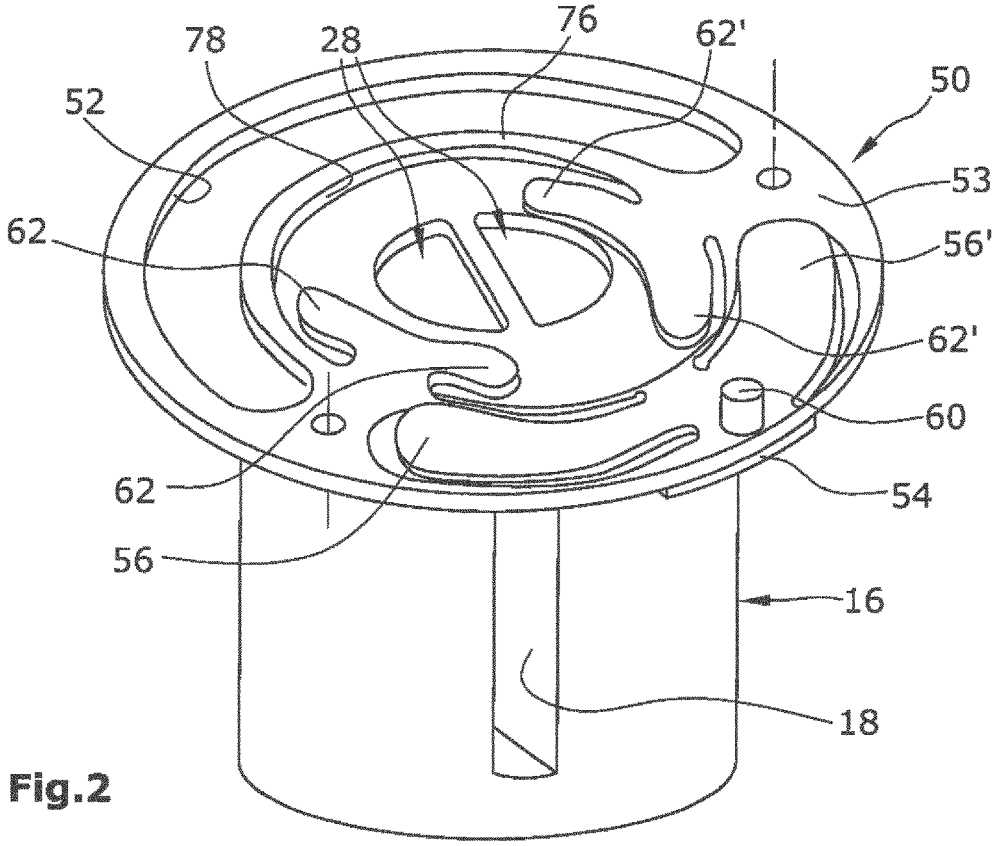
FIG. 2 shows a perspective view of the pump rotor body and the retaining sheet body of the pump of FIG. 1.
Figure 3:
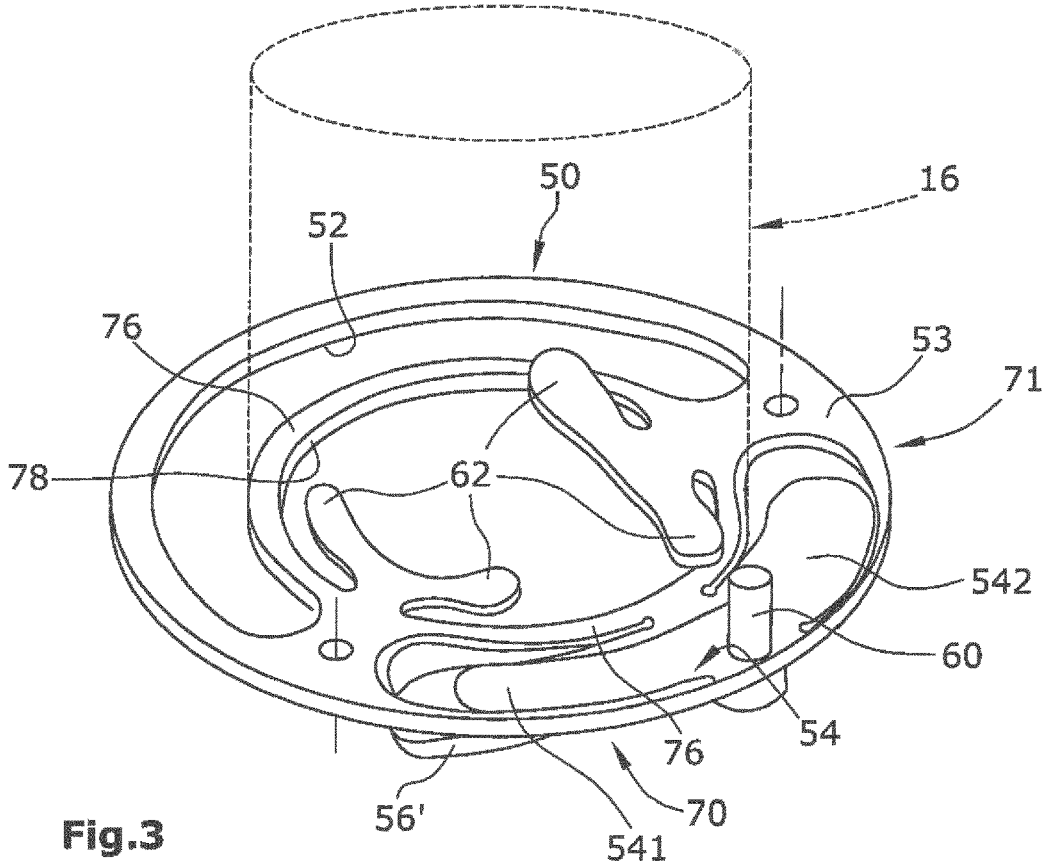
FIG. 3 shows another perspective view of the retaining sheet body of FIG. 2.

The retaining sheet body 53 has a complex structure and has several functions as can best be seen in FIGS. 2 and 3. The retaining sheet body 53 is basically a flat sheet metal ring with a center opening 78 so that the coupling structure 28 of the pump rotor body 16 is axially accessible for the corresponding coupling structure 30 of the drive 26, as shown in FIGS. 1 and 2. The retaining sheet body 53 defines a ring-like retaining ring 76 for axially blocking the corresponding outer ring portion of the high pressure front end 17 of the pump rotor body 16, as can be seen in FIGS. 1 and 2. The inner diameter of the retaining ring 76 is smaller than the outer diameter of the pump rotor body 16, and can, for example, be 5 to 10 mm smaller. The retaining ring 76 stops the pump rotor body 16 from axially moving outwardly in the direction of the recess 63.

The retaining sheet body 53 is provided with four integral elastic rotor biasing elements 62, 62' for axially pushing the pump rotor body 16 away from the retaining sheet body 53 so that the low-pressure sided front end rotor surface 49 is always held adjacent to or even in contact with the corresponding inside surface 47 of the housing cover 14, even if the vacuum pump 10 is not operating and no axial pressure difference is present. The elastic rotor biasing elements 62, 62' are provided as two sets of double-tongues which are provided as integral parts of the retaining sheet body 53. The tongues respectively extend in a circumferential direction and are minimally bent in the axial direction towards the corresponding high pressure front end 17 of the pump rotor body 16.

The retaining sheet body 53 is provided with a half-circular strip-like cutout 52 opposite the outlet valves 70, 71.

The retaining sheet body 53, a separate spring element 54, and the valve openings 34 together define two separate outlet valves 70, 71. The retaining sheet body 53 is provided with and defines two integral and partially cut-out spring stoppers 56 which are provided as one set of two tongues. The spring stoppers are bent in the distal direction to allow the underlying spring sheet valve bodies 541, 542, which are defined by the spring element 54, to be axially lifted away from the valve seats defined by the opening edge of the valve openings 34. The outlet valves 70, 71 are so-called check valves which open if the pressure difference inside the pump cavity 11 is sufficiently higher than atmospheric pressure. The mechanic opening range of the spring sheet valve bodies 541, 542 is limited by the spring stoppers 56, 56'.

The spring element 54 and the retaining sheet body 53 are together fixed at the housing main body 21 by a fixation bolt 60. Additional fixation bolts are provided to fix the retaining sheet body 53 at the housing main body 21 over the entire circumference of the circular retaining sheet body 53.

The present invention is not limited to embodiments described herein; reference should be had to the appended claims.

What is claimed is:

1. An automotive vacuum pump for pumping a gas, the automotive vacuum pump comprising:

a pump housing configured to define a pump cavity, the pump housing comprising a closed housing wall and a housing main body which comprises a cylindrical inside ring surface portion;

a shiftable vane;

a pump rotor body comprising, at least one vane slit which is configured to support the shiftable vane so as to define at least two rotating pumping chambers, an axial low-pressure end which is axially supported by the closed housing wall so that a gas pressure inside the at least two rotating pumping chambers is present at the low-pressure end of the pump rotor body, a cylindrical outside ring surface, and an axial high-pressure end, the pump housing being configured to be fluidically open at the axial high-pressure end so that atmospheric pressure is present at the axial high-pressure end;

a separate axial rotor retaining arrangement comprising a separate retaining sheet body which is arranged in a transversal plane and which is configured to axially block at least partially the axial high-pressure end of the pump rotor body; and a radial friction bearing arranged axially between the at least one vane slit and the axial high-pressure end of the pump rotor body, the radial friction bearing being defined by the cylindrical outside ring surface portion of the pump rotor body and the cylindrical inside ring surface portion of the housing main body, the radial friction bearing directly rotatably supporting the pump rotor body at the pump housing and pneumatically separating the pump cavity from atmospheric pressure.

2. The automotive vacuum pump as recited in claim 1, wherein, the axial high-pressure end of the pump rotor body comprises an outer ring portion, and the separate retaining sheet body is configured to define a retaining ring which blocks the outer ring portion of the axial high-pressure end of the pump rotor body.

3. The automotive vacuum pump as recited in claim 1, further comprising:

a drive comprising a coupling structure, wherein, the pump rotor body further comprises a coupling structure, the coupling structure of the drive corresponds to the coupling structure of the pump rotor body, and the separate retaining sheet body is configured to define a center opening so that the coupling structure of the pump rotor body is axially accessible for the coupling structure of the drive.

4. The automotive vacuum pump as recited in claim 1, further comprising:

a lubrication conduit arrangement configured to lubricate the radial friction bearing with a lubrication liquid.

5. The automotive vacuum pump as recited in claim 1, further comprising:

a fluidic pump outlet valve, wherein, the separate retaining sheet body is configured to define a spring stopper of the fluidic pump outlet valve.

6. The automotive vacuum pump as recited in claim 1, further comprising:

a separate spring sheet valve body arranged between the separate retaining sheet body and the pump housing.

7. The automotive vacuum pump as recited in claim 1, further comprising:

two separate pump outlet valves arranged at the axial high-pressure end of the pump housing, wherein, the separate retaining sheet body is configured to define a respective spring stopper for each of the two separate pump outlet valves.

8. The automotive vacuum pump as recited in claim 1, wherein the separate retaining sheet body is further configured to define an elastic rotor biasing element which is configured to axially push the pump rotor body away from the separate retaining sheet body.

9. The automotive vacuum pump as recited in claim 1, further comprising:

an axial friction bearing, wherein, the closed housing wall of the pump housing is provided as a housing cover, the pump rotor body further comprises a front end surface at the axial low-pressure end, and the axial friction bearing is defined by the housing cover and by the front end surface.

10. The automotive vacuum pump as recited in claim 1, wherein the pump rotor body further comprises a lateral outside which is configured to be stepless and cylindrical over an entire axial extent.

11. The automotive vacuum pump as recited in claim 1, wherein the pump rotor body comprises one single continuous vane slit as the at least one vane slit, the one single continuous vane slit being configured to support the shiftable vane so as to separate the pump cavity into two rotating pumping chambers.

* * * * *